US006085626A

United States Patent [19]

Pfaff, Jr.

[11] Patent Number: 6,085,626

[45] Date of Patent: Jul. 11, 2000

[54] RAPID ADJUSTMENT ROTARY DIES

[75] Inventor: Alan R. Pfaff, Jr., Orchard Lake, Mich.

[73] Assignee: Atlantic Commerce Properties, Southfield, Mich.

[21] Appl. No.: 09/232,489

[22] Filed: Jan. 15, 1999

[51] Int. Cl.[7] ..... B26D 5/02

[52] U.S. Cl. ..... 83/698.51; 83/699.51

[58] Field of Search ..... 83/698.51, 698.41, 83/698.61, 699.51, 665, 670, 331, 344, 343, 345

[56] References Cited

U.S. PATENT DOCUMENTS

| | | | |
|---|---|---|---|
| 2,659,436 | 11/1953 | Dutro et al. | 83/482 |
| 3,283,635 | 11/1966 | Johnson | 83/345 |
| 3,863,537 | 2/1975 | Huelsman | 83/698.51 X |
| 4,608,895 | 9/1986 | Bell et al. | 83/345 |
| 5,365,815 | 11/1994 | Pfaff, Jr. | 83/154 |
| 5,417,132 | 5/1995 | Cox et al. | 83/116 |
| 5,842,399 | 12/1998 | Pfaff, Jr. | 83/343 |

*Primary Examiner*—M. Rachuba
*Assistant Examiner*—Dominic Troiano
*Attorney, Agent, or Firm*—Reising, Ethington, Barnes, Kisselle, Learman & McCulloch, P.C.

[57] ABSTRACT

A system to accurately align relative to each other a pair of rotary die cylinders having co-acting cutting blades formed by integral lands projecting generally radially outwardly from each cylinder. Each cylinder has an alignment groove formed therein such that when the cutting blades of the die cylinders are in alignment, the alignment grooves of each cylinder are aligned and define a slot between the cylinders which is constructed to receive an alignment pin. To initially align the die cylinders relative to each other, they are free to move both axially and rotatably relative to each other to permit the die cylinders to fully engage an alignment pin or pins inserted between the cylinders. Preferably, an alignment slot is provided adjacent each end of each cylinder with each slot constructed to receive a separate alignment pin to more accurately register or align the die cylinders relative to each other. With the cylinders fully engaging the alignment pins ensuring accurate alignment of the die cylinders, the bearings and other adjustment and cylinder mounting mechanisms may be locked in position to secure the cylinders in position and the alignment pins subsequently removed prior to operation of the rotary die cylinder machine.

24 Claims, 3 Drawing Sheets

RAPID ADJUSTMENT ROTARY DIES

FIELD OF THE INVENTION

This invention relates generally to cutting blanks from thin sheets or webs of material and more particularly to improved rotary cutting dies for cutting the blanks.

BACKGROUND OF THE INVENTION

Previously, a pair of superimposed rotary dies with cutting blades on one or both dies have been used to cut blanks from a thin web of material passing between the dies. Typically, the thin web is of a material such as paper, paperboard, cardboard, plastic film, metal foil, thin sheet metal, and the like. Such material may be received on a large roll and substantially continuously fed between the rotating dies to provide a relatively high rate of production of cut blanks from the web of material.

U.S. Pat. No. 4,608,895 discloses a pair of rotary die cylinders with integral complementary cutting blades thereon which coact to sever a web of material passing between the dies. While these die cylinders can be shifted both axially and in rotational phase relation with respect to each other to enable proper registration of the co-acting cutting blades to cut a web, the process to properly register the die cylinders is complicated and time consuming.

Generally, a soft, "putty-like" material is placed on each die cylinder so that upon rotation of the die cylinders, the cutting blades of each cylinder would form an impression in the putty on the opposed cylinder to enable an operator to determine the extent to which the die cylinders are offset and/or out of phase. From this, the dies are adjusted axially or in rotational phase relative to each other to properly align the cutting blades of each die cylinder. Preferably, after each such adjustment, additional putty is placed on each die cylinder and an impression in the putty is obtained by rotating the cylinders to ensure proper alignment of the rotary dies. This procedure is repeated until the proper registration or alignment of the rotary dies is achieved. Further adjustments may also be necessary if the center line or axis of rotation of the rotary dies are not parallel or are skewed relative to each other. In this case, one or both of the rotary dies must be shimmed or otherwise adjusted to provide for parallel axes of rotation of the rotary dies. Such adjustments also require the placement of putty on the rotary dies to insure that the adjustments have placed the rotary dies in the proper registration relative to each other. Obviously, this labor intensive, empirical adjustment process is rather complex and time consuming and increases the time to initially set up a machine, and to change one or both of the rotary dies and hence increases the downtime of the machine.

SUMMARY OF THE INVENTION

A system to accurately align relative to each other a pair of rotary die cylinders having co-acting cutting blades formed by integral lands projecting generally radially outwardly from each cylinder. Each cylinder has an alignment groove formed therein such that when the cutting blades of the die cylinders are in alignment, the alignment grooves of each cylinder are aligned and define a slot between the cylinders which is constructed to receive an alignment pin. To initially align the die cylinders relative to each other, they are free to move both axially and rotatably relative to each other to permit the die cylinders to fully engage an alignment pin or pins inserted between the cylinders. Preferably, an alignment slot is provided adjacent each end of each cylinder with each slot constructed to receive a separate alignment pin to more accurately register or align the die cylinders relative to each other. With the cylinders fully engaging the alignment pins ensuring accurate alignment of the die cylinders, the bearings, drive gears, and other adjustment and cylinder mounting mechanisms may be locked in position to secure the cylinders in position and the alignment pins subsequently removed prior to operation of the rotary die cylinder cutting machine.

Preferably, the coacting cutting blades and the alignment slot on each cylinder are formed generally at the same time and by the same machine, such as a CNC machine, to ensure alignment of the slots relative to the blades. Thus, the alignment slots are formed in each of the cylinders to ensure that corresponding alignment slots are themselves accurately aligned when the cutting blades of the die cylinders are accurately aligned. With the alignment slots accurately formed, the rotary die cylinders may be rapidly aligned when initially set up on a rotary die cylinder machine or when replacing or interchanging various rotary die cylinders to reduce the downtime and thereby increase the productivity of the machine in use.

Objects, features and advantages of this invention are to provide rotary die cylinders which greatly facilitate the alignment of the cylinders relative to each other, reduce the downtime of the cutting machine, facilitate replacing or interchanging rotary dies on a cutting machine, increase the productivity of the cutting machine and are of relative simple design and economical manufacture and assembly.

BRIEF DESCRIPTION OF THE DRAWINGS

These and other objects, features and advantages of this invention will be apparent from the following detailed description of the preferred embodiment, appended claims and accompanying drawings in which:

DETAILED DESCRIPTION OF THE PREFERRED EMBODIMENT

Figure 1:
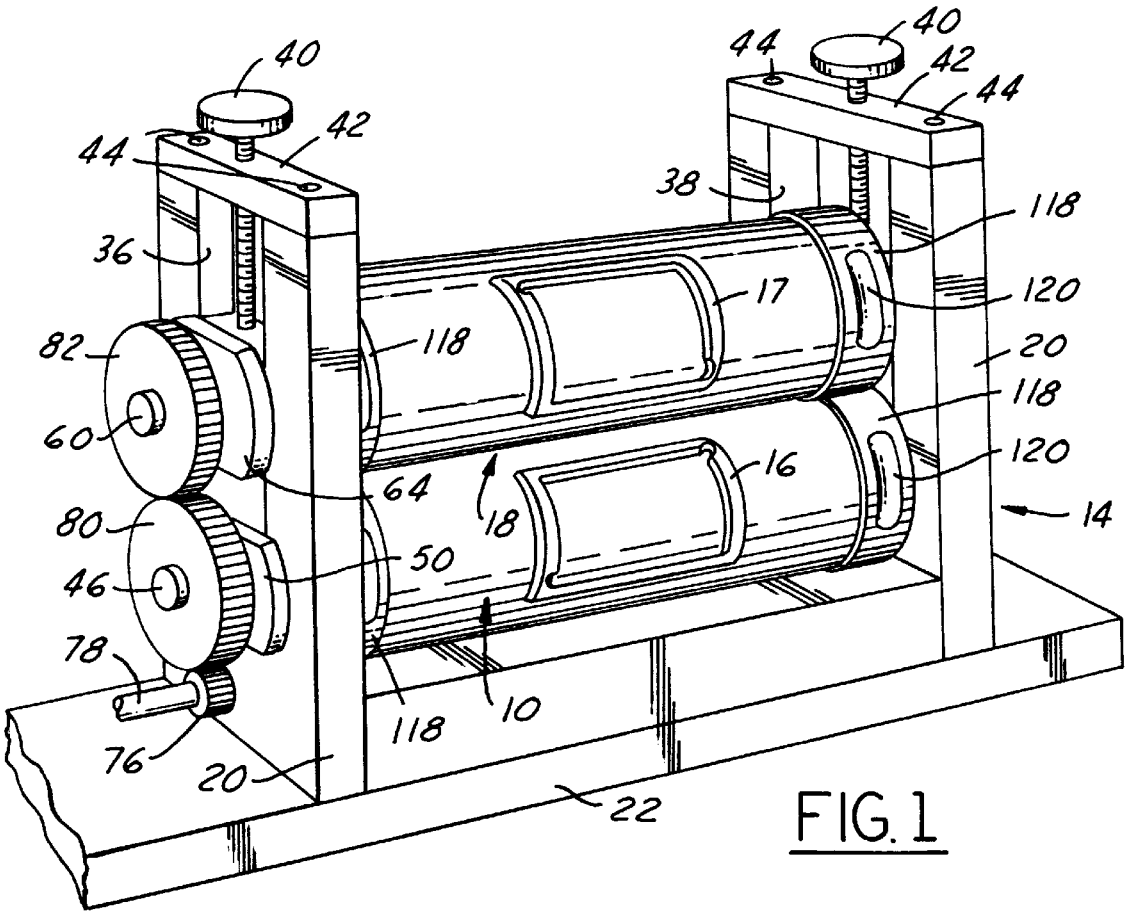
FIG. 1 is a simplified perspective view of a pair of cutting die cylinders viewed in a die stand and embodying this invention.
Figure 2:
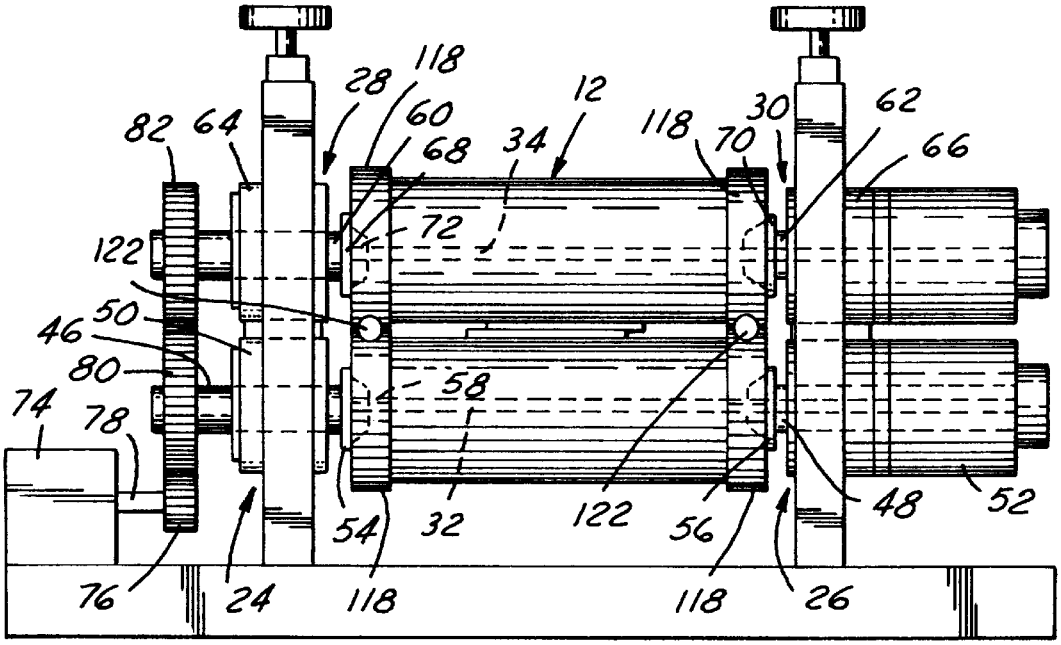
FIG. 2 is a side view of the die cylinders and stand of FIG. 1.

Referring in more detail to the drawings, FIGS. 1 and 2 illustrate a pair of rotary die cylinders 10, 12 embodying this invention and received in a die stand 14. When co-rotating, cutting blades 16 and 17 on cylinders 10, 12 cut blanks or workpieces and usually some associated scrap pieces from a web of thin material (not shown) passing through the nip 18 of the die cylinders 10, 12. For carrying the cylinders, the die stand 14 has a pair of spaced apart uprights 20 fixed to a base 22.

Each die cylinder 10, 12 is journalled for rotation by a pair of arbor assemblies 24, 26 and 28, 30 removably connected to an associated cylinder by a draw bar 32, 34 and removably received in guide ways or slots 36, 38 in the uprights 20 of the stand 14. The arbors 24–30 are releasably clamped in the stand 14 by threaded screws 40 carried by cross bars 42 secured by cap screws 44 to the upper ends of the uprights 20.

The lower cylinder 10 is driven through the arbor assemblies 24 and 26 which have separate spindles 46, 48 journalled for rotation by preferably a roller bearing (not shown) and received in mounting blocks 50, 52. To support the lower cylinder 10 and coaxially align the spindles 46, 48 with it, the spindles 46, 48 have frustoconical nose portions 54, 56 slidably received in complementary frustoconical recesses in opposed ends of the cylinder 10. To drive the cylinder 10 for co-rotation with the spindles 46, 48, the spindles 46, 48 have a key (not shown) constructed to be received in complementary grooves in the cylinder. The spindles 46, 48 are drawn into firm engagement with the recesses in the cylinder 10 by the draw bar 32 which has a threaded end portion removably received in a complementary threaded blind bore 58 in the nose end 54 of the spindle 46.

The upper cylinder 12 is driven through the arbor assemblies 28 and 30 which have separate spindles 60, 62 journalled for rotation by bearings received in mounting blocks 64, 66. The spindles 60, 62 are coaxially aligned with and support the upper cylinder 12 by the cooperation of a frustoconical nose portions 68, 70 received in a complementary recesses in the opposed ends of the cylinder 12. In assembly, to ensure that the spindles 60, 62 and cylinder 12 rotate in unison, a key of the spindle (not shown) is slidably received in a complementary groove in the cylinder. The spindles 60, 62 are releasably drawn into engagement with the cylinder 12 by rotation of the draw bar 34 which extends through one arbor assembly 30 and the cylinder 12 and has a threaded end portion received in a complementary threaded bore 72 in the nose 68 of the spindle 60 of the other arbor assembly 28.

To the extent thus far described, the cylinders 10 and 12, arbor assemblies 24–30 and the die stand 14 are substantially as described in U.S. Pat. No. 5,842,399 issued Dec. 1, 1998, the disclosure of which describes in greater detail the arbor assemblies and cylinders and is incorporated herein by reference in its entirety.

In assembly, the cylinders 10, 12 are preferably driven by an electric motor 74 with a pinion gear 76 on its output shaft 78 which meshes with a driven gear 80 releasably coupled to the spindle 46 associated with the lower cylinder 10. The driven gear 80 in turn meshes with a gear 82 releasably coupled to the spindle 60 associated with the upper cylinder 12 so that the lower and upper cylinders 10, 12 co-rotate at the same speed.

Figure 6:
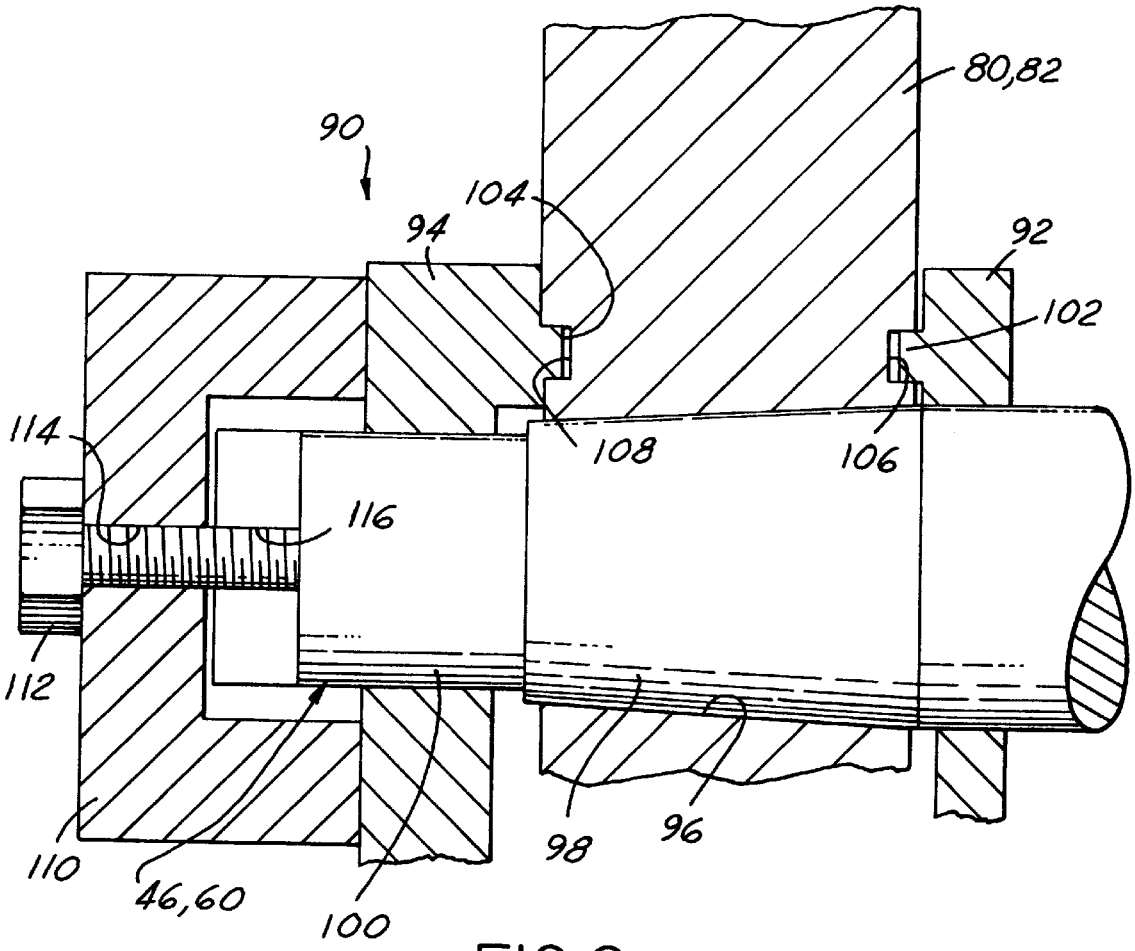
FIG. 6 is a fragmentary sectional view of a removable gear assembly to facilitate rapidly engaging and disengaging a gear from a spindle.

As shown in FIG. 6, to facilitate engaging and disengaging the gears 80, 82 from the spindles 46, 60, a removable locking gear assembly 90 is provided for each gear 80, 82. Each gear assembly 90 has a gear release nut 92, a gear 80 or 82 and a gear mounting nut 94 all removably received on the spindle 46 or 60. The gears 80, 82 have a tapered bore 96 constructed to engage a complementary tapered portion 98 of the spindle 46 or 60. The gear mounting nut 94 is received on a threaded portion 100 of the spindle 46, 60 and is advanced to urge the gears 80, 82 into firm engagement with the tapered portion 98 of their spindles 46, 60 for co-rotation of the gears 80, 82 and spindles 46, 60. The gear release nut 92 is disposed on the opposite side of the gears 80, 82 from the gearing mounting nut 94 and is advanced when the gear mounting nut 94 is backed off the gears 80, 82 to disengage the gears 80, 82 from their spindles 46, 60.

Preferably, to maintain the gears 80, 82 essentially coaxial with their spindles 46, 60, both the gear release nut 92 and the gear mounting nut 94 have annular gear support ribs or projections 102, 104, respectively, which are received in generally complementary grooves 106, 108 formed in the gears 80, 82. Also preferably, to ensure the gears 80, 82 remain mounted on their spindles 46, 60, a locking body 110 is provided adjacent the gear mounting nut 94 to prevent the nut 94 from loosening in use. The locking body 110 is preferably generally cup-shaped or C-shaped, is received over the end of the spindle 46, 60 and is connected thereto by a cap screw 112 extending through a bore 114 in the body 110 and received in a threaded bore 116 in the spindle 46, 60.

According to the present invention, both the lower and upper die cylinders 10, 12 preferably have axially and generally radially outwardly extending and generally circumferentially continuous lands or bearer areas 118 adjacent each end. Preferably, conventional cutting tools are used to remove the material inboard of the bearer areas 118 to define the cutting blades 16 on each cylinder 10, 12 inboard of the bearer areas 118. The bearer areas 118 preferably have a radius equal to or greater than the radius of the cutting blades 16 to prevent the cutting blades 16 from radially overlapping and interfering with each other. After the material surrounding the cutting blades 16 is removed, the cutting blades 16 may be heat treated to harden them as desired.

Figure 7:
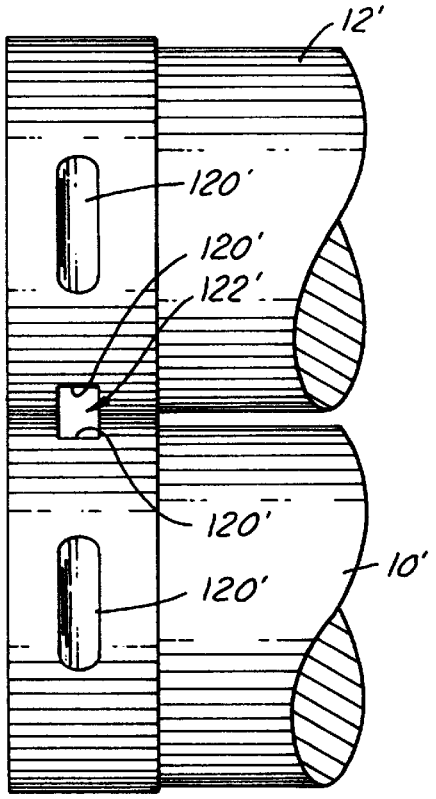
FIG. 7 is a fragmentary side view of a pair of cylinders having alignments defining a generally rectangular opening when aligned.
Figure 4:
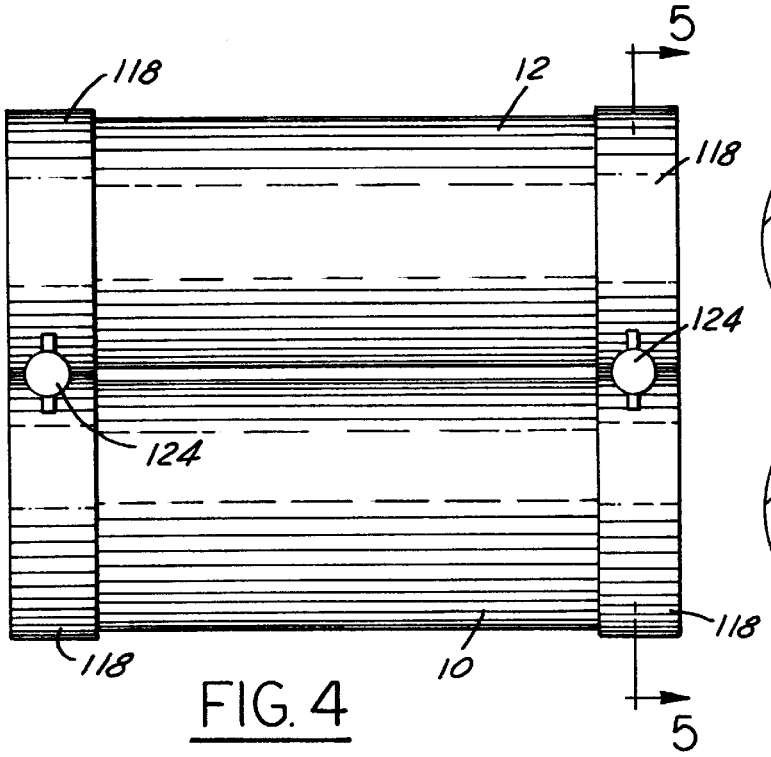
FIG. 4 is a side view of a pair of die cylinders with a pair of alignment pins received between the cylinders to accurately align them.
Figure 5:
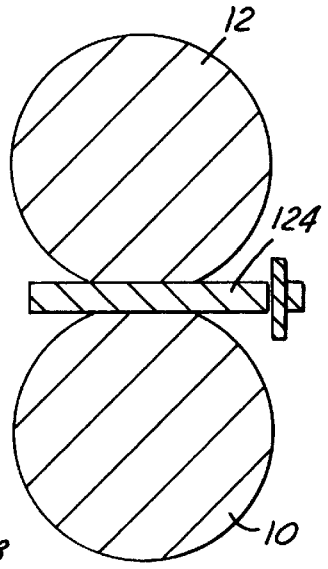
FIG. 5 is a cross sectional view taken along the line 5—5 in FIG. 4.

One or more alignment slots 120 are formed in each cylinder 10, 12 and are preferably formed in each bearer area 118 of each cylinder 10, 12. The alignment slots 120 preferably extend essentially perpendicular to the axis of rotation of the cylinders 10, 12 and are preferably semicircular in cross section although other shapes of alignment slots 120 may also be used. The alignment slots 120 formed in the bearer areas 118 of the lower cylinder 10 are complementary to the alignment slots 120 formed in the bearer areas 118 of the upper cylinder 12. When the alignment slots 120 of t he lower cylinder 10 are aligned with the slots 120 of the upper cylinder 12, a circular opening or a cylindrical passage 122 (FIG. 3) is defined between the cylinders 10, 12. Alternatively, as shown in FIG. 7, modified alignment sots 120' may be provided on the upper and lower cylinders 10' and 12' which define a generally rectangular opening 122' between them when the cylinders 10', 12' are aligned. To ensure proper orientation of the cutting blades 16, 17 the alignment slots 120 of each cylinder 10, 12 are formed such that when they are aligned, the cutting blades 16, 17 of cylinders 10, 12 are properly aligned both axially and in rotational phase with one another and with their axes of rotation being parallel. Desirably, to ensure proper alignment of the cylinder 10, 12 and cutting blades 16, 17, the alignment slots 120 are formed generally at the same time and preferably on the same CNC machine as the cutting blades 16, 17.

Figure 3:
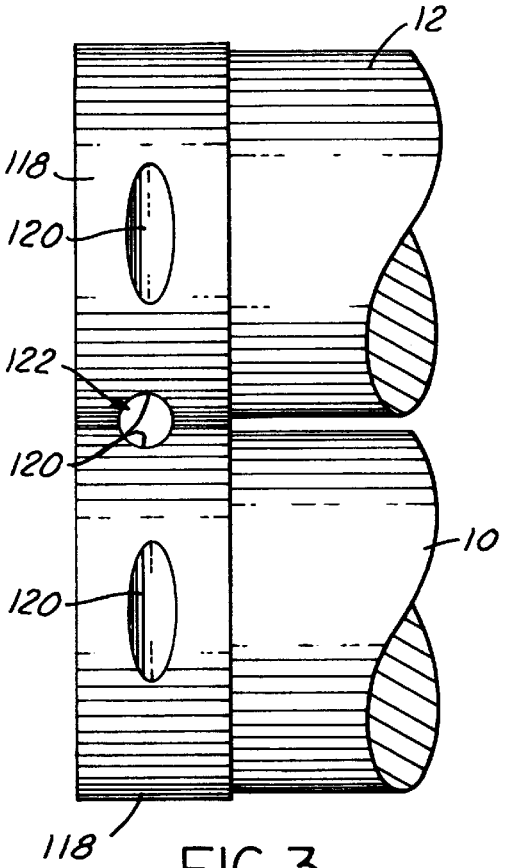
FIG. 3 is a fragmentary side view of a pair of cylinders having alignment slots machined therein constructed to receive alignment pins.

When the alignment slots 120 are essentially perfectly aligned thereby ensuring alignment of the cutting blades 16, 17 of the cylinders 10, 12, a cylindrical dowel or alignment pin 124 (or an alignment pin generally rectangular in cross-section may be used with the alignment slots 120' defining opening 122') may be inserted into each opening 122 defined by the alignment slots 120 to hold the cylinders 10, 12 in their aligned position. The alignment pins have essentially the same diameter as the slots 120 and may be lapped therein. Thus, with the alignment pins 124 received between the cylinders 10, 12, the arbor assemblies 24–30 may be engaged with the cylinders 10, 12 to firmly hold the cylinders 10, 12 in the parallel axes, rotary phase and axially aligned position defined by the cooperation of the alignment slots 120 and pins 124. To accommodate for wear of the cutting blades 16 and to permit the cylinders 10, 12 to be indexed into sequential cutting positions with parallel axes, rotary phase and axial alignment, as shown in FIG. 3, a plurality of circumferentially spaced apart alignment slots 120 may be formed in the bearer areas 118 of both cylinders 10, 12 to facilitate properly aligning the die cylinders 10, 12 after their worn blades 16, 17 have been resharpened.

In assembly, the lower cylinder 10 is first inserted into the die stand 14 followed by the upper cylinder 12. To facilitate alignment of the cylinders 10, 12, both cylinders 10, 12 are free to move axially, to rotate relative to each other and for their axes to shift when initially received on the stand 14. To permit the cylinders 10, 12 to freely rotate, the gears 80, 82 are not intermeshed and are not firmly engaged with the tapered portion 98 of their spindles 46, 60. A pair of alignment grooves 120 in the lower cylinder 10 are generally aligned with the corresponding pair of alignment grooves 120 in the upper cylinder 12 and the alignment pins 124 are inserted in the openings 122 defined by the aligned alignment grooves 120. The relatively free movement of the cylinders 10, 12 allows them to substantially fully engage the alignment pins 124 received between the cutting blades 16, 17 cylinders 10, 12 to ensure that the cylinders 10, 12 are properly aligned both axially and in rotary phase with respect to each other and to also ensure that the axes of rotation of the cylinders 10, 12 are parallel to prevent skewing of the cylinders. With the alignment pins 124 received between the die cylinders 10, 12, the draw bars 32, 34 may be rotated to firmly engage the arbor assemblies 24–30 with their respective cylinders 10, 12 to firmly hold the cylinders in place on the die stand 14.

With the cylinders 10, 12 accurately aligned and secured on the die stand 14, the gears 80, 82 can be engaged with their spindles 46, 60 and meshed with each other to be driven by the pinion gear 76 for co-rotation of the cylinders 10, 12 in opposed directions. To engage each gear 80, 82 with its spindle 46, 60, the gear release nut 92 of the gear assembly 90 is backed off from the gear 80, 82 and the gear mounting nut 94 is advanced to urge the gear 80, 82 into firm engagement with the tapered portion 98 of its spindle 46, 60 to firmly hold the gear 80, 82 on its spindle 46, 60. The cap screw 112 is then firmly tightened to engage the locking body 110 with the gear mounting nut 94 to prevent the nut 84 from loosening or rotating in use. Although only the gear 80 associated with the lower cylinder 10 needs to be released from its spindle 46 to permit free rotation of the cylinders 10, 12 when aligning them, it may be desirable to release both gears 80, 82 from their spindles 46, 60 to ensure free rotation of their cylinders 10, 12 when aligning them. With the gears 80, 82 firmly mounted on their spindles 46, 60 and intermeshed with each other, they may be driven in unison by the motor 74 through the pinion gear 76 to cause co-rotation of the cylinders 10, 12 for cutting a web of material.

With rotary die cylinders 10, 12 having the alignment slots 120 or 120' and associated alignment pins 124, according to this invention, a pair of die cylinders 10, 12 may be quickly and easily aligned without the necessity for manually adjusting the cylinders based on empirical experiments to determine the alignment of the cylinders. This reduces the downtime of the cutting machine and facilitates replacing worn cylinders 10, 12 or interchanging different cylinders on a cutting machine to cut different parts or webs of material. Thus, the productivity and efficiency of the rotary die cutting machine is improved.

What is claimed is:

1. An apparatus comprising:

a pair of rotary dies each having at least one cutting blade and at least one alignment slot formed therein with a cutting blade of one rotary die constructed to be aligned both axially and in rotary phase with a cutting blade of the other rotary die when an alignment slot of one rotary die is aligned with an alignment slot of the other rotary die, and when the alignment slots are aligned, the alignment slot of one rotary die opens onto the alignment slot of the other rotary die to define an opening between them to receive an alignment pin.

2. The apparatus of claim 1 wherein the alignment slots are formed along an axis essentially perpendicular to the axis of rotation of the dies.

3. The apparatus of claim 1 wherein each die has a pair of axially spaced, generally radially extending bearer areas and at least one alignment slot formed in each bearer area.

4. An apparatus comprising:

a pair of rotary dies each having at least one cutting blade and at least one alignment slot formed therein with a cutting blade of one rotary die constructed to be aligned both axially and in rotary phase with a cutting blade of the other rotary die when an alignment slot of one rotary die is aligned with an alignment slot of the other rotary die, and the alignment slots of the rotary dies are generally complementary in shape and are constructed to receive an alignment pin when aligned to facilitate aligning the rotary dies and cutting blades.

5. The apparatus of claim 4 wherein the alignment slots are generally semi-circular in cross section.

6. The apparatus of claim 4 wherein when one alignment slot of one die is aligned with an alignment slot of the other die a generally rectangular opening is defined between them.

7. An apparatus comprising:

a stand;

a pair of rotary dies rotatably mounted on the stand, each die has at least one cutting blade and an alignment slot formed therein with the slot in one rotary die constructed to be aligned with the slot in the other rotary die when the cutting blade of the rotary dies are aligned with each other; and an alignment pin constructed to be received within the alignment slots when the dies are properly aligned.

8. The apparatus of claim 7 which also comprises a second alignment slot formed in each rotary die axially spaced from the other alignment slots and with the second alignment slots constructed to be aligned with each other to receive a second alignment pin to aid in aligning the rotary dies.

9. The apparatus of claim 7 wherein the alignment slots are generally semi-circular in cross section.

10. The apparatus of claim 7 wherein the alignment slots are formed along an axis essentially perpendicular to the axis of rotation of the dies.

11. The apparatus of claim 7 wherein each die has a pair of axially spaced, generally radially extending bearer areas and at least one alignment slot formed in each bearer area.

12. The apparatus of claim 7 which also comprises a mounting assembly to releasably secure each die on the stand, the mounting assembly permits each die to initially move axially, rotatably on its axis of rotation and rotatably about an axis generally transverse to its axis of rotation so that each die may generally completely engage an alignment pin received between the dies to ensure proper alignment of the dies and thereafter, the mounting assembly can be adjusted to secure the dies to the stand in their aligned position.

13. The apparatus of claim 12 wherein the mounting assembly has a pair of arbor assemblies for each die with an arbor assembly disposed at each end of each die.

14. The apparatus of claim 7 wherein the alignment slots are formed in the outer periphery of the dies and the alignment pin is received within the alignment slots and between the dies.

15. The apparatus of claim 7 wherein the alignment slots are shaped such that when an alignment slot of one die is aligned with an alignment slot of the other die, a generally rectangular opening is defined between them.

16. The apparatus of claim 7 which also comprises:

a motor;

a driving gear coupled to the motor;

a pair of mounting assemblies to releasably secure the dies to the stand, each mounting assembly having a shaft with a tapered portion;

a pair of driven gears with one driven gear intermeshed with both the driving gear and the other driven gear for co-rotation of all the gears, each driven gear has a tapered mounting bore constructed to be releasably received on a tapered portion of a shaft of a mounting assembly such that when each driven gear is firmly received on its respective shaft of the mounting assembly and a driving gear is rotated, each driven gear rotates to cause rotation of each die and each driven gear may be released from the shaft so that the dies may rotate relative to the driven gears to facilitate aligning the dies.

17. The apparatus of claim 16 which also comprises a gear mounting nut rotatably received on each shaft adjacent a gear, each gear mounting nut may be rotated in a first direction to force a driven gear firmly onto a shaft and to hold the driven gear on the shaft and may be rotated in a second direction permitting the driven gear to be released from the shaft.

18. The apparatus of claim 17 which also comprises a gear release nut rotatably received on each shaft adjacent a gear, each gear release nut may be backed off from a driven gear to permit the driven gear to fully engage the tapered portion of a shaft and may be advanced toward the driven gear to release the driven gear from the tapered portion of the shaft.

19. The apparatus of claim 17 which also comprises a gear support projection on the gear mounting nut constructed to be received in a complementary slot in a driven gear to maintain the driven gear concentric with the shaft when the driven gear is released from the tapered portion of the shaft.

20. The apparatus of claim 19 wherein the gear support projection is generally annular.

21. The apparatus of claim 18 which also comprises a gear support projection on the gear release nut constructed to be received in a complementary slot in a driven gear to maintain the driven gear concentric with the shaft when the driven gear is released from the tapered portion of the shaft.

22. The apparatus of claim 21 wherein the gear support projection is generally annular.

23. The apparatus of claim 17 which also comprises a locking body constructed to releasably hold the gear mounting nut against the driven gear to prevent the gear mounting nut from disengaging from the driven gear when it is desired to hold the driven gear firmly on the shaft.

24. The apparatus of claim 23 wherein the locking body is releasably connected to the shaft.

* * * * *